US007510309B1

(12) United States Patent
Rizzo et al.

(10) Patent No.: US 7,510,309 B1
(45) Date of Patent: Mar. 31, 2009

(54) PORTABLE UNDER-MOUNT LIGHTING ASSEMBLY

(76) Inventors: Dorothy J. Rizzo, 11520 Shipwatch Dr., #1583, Largo, FL (US) 33774; Joseph W. Rizzo, 11520 Shipwatch Dr., #1583, Largo, FL (US) 33774

( * ) Notice: Subject to any disclaimer, the term of this patent is extended or adjusted under 35 U.S.C. 154(b) by 122 days.

(21) Appl. No.: 11/527,038

(22) Filed: Sep. 26, 2006

Related U.S. Application Data

(60) Provisional application No. 60/721,353, filed on Sep. 29, 2005.

(51) Int. Cl.
*F21S 8/08* (2006.01)

(52) U.S. Cl. ..... 362/418; 362/133; 362/134; 362/239; 362/125; 362/249; 362/238; 362/250; 362/800; 362/236

(58) Field of Classification Search ..... 362/133, 362/418, 800, 249, 134, 419, 125, 250, 238, 362/227, 236, 240, 239
See application file for complete search history.

(56) References Cited

U.S. PATENT DOCUMENTS

| | | | | |
|---|---|---|---|---|
| 5,544,028 | A | 8/1996 | Carlin | |
| 5,559,681 | A | 9/1996 | Duarte | |
| 5,769,529 | A * | 6/1998 | Weinstock et al. | 362/133 |
| 6,033,088 | A | 3/2000 | Cantigiani | |
| 6,641,283 | B1 * | 11/2003 | Bohler | 362/238 |

* cited by examiner

*Primary Examiner*—Stephen F Husar
*Assistant Examiner*—Jessica L McMillan

(57) ABSTRACT

A lighting assembly includes a base plate having a longitudinal axis and a pair of linear edges equidistantly spaced therefrom. The linear edges extend parallel to the axis and along a longitudinal length of the plate. The linear edges are provided with a flange portion formed therewith and extending along a length thereof. The flange portions terminate at a predetermined distance above a top surface of the plate. Light fixtures are adjustably positional along the plate, and each of the fixtures has an LED housed therein. Slots are formed within the plate, and each of the slots has first, second, third and fourth segments aligned along offset quadrants. A mechanism slides the light fixtures within the slots and another mechanism locks the light fixtures within corresponding ones of the slots. A mechanism under mounts the linear edges to a bottom surface of a support.

18 Claims, 5 Drawing Sheets

PORTABLE UNDER-MOUNT LIGHTING ASSEMBLY

CROSS REFERENCE TO RELATED APPLICATIONS

This application claims the benefit of U.S. Provisional Application No. 60/721,353, filed Sep. 29, 2005.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to lighting assemblies and, more particularly, to a portable under-mount lighting assembly for illuminating a space-restricted region.

2. Prior Art

Strip lighting assemblies are frequently used to provide illumination for displays, bookcases, shelving, and other areas to provide bright light while maintaining light bulbs and wiring in relative obscurity. Ideally, such assemblies should be easy to mount, and provide for a variety of choices in terms of types and spacing of light bulbs. Furthermore, it may be desirable to keep such an assembly to a relatively narrow width, so that the assembly itself is not as noticeable as the objects being illuminated and displayed. Strip lighting assemblies are useful for supporting and illuminating light bulbs in a variety of contexts, including bookshelves and display cases, while maintaining the lighting hardware and wiring in relative obscurity, to avoid detracting from the display being illuminated.

One prior art example shows a strip lighting assembly which arranges two conductive strips in vertical fashion to achieve a relatively narrow and non-obtrusive assembly. A special socket design is also provided, which may accommodate a variety of light bulbs or power chords. The socket includes a movable insert which may be adjusted to alter the size of the receptacles of the socket, increasing the receptacle area to accommodate larger light bulb terminals or power chords, and decreasing the receptacle area to snugly fit smaller light bulb terminals. Unfortunately, this example does not allow for alternate modes of powering the lighting assembly, such as batteries for example. Additionally, this example does not include a sensor, which would turn the lighting assembly on or off at preset levels of ambient light.

Accordingly, a need remains for a portable under-mount lighting assembly in order to overcome the above-noted shortcomings. The present invention satisfies such a need by providing an assembly that is convenient and easy to use, is lightweight yet durable in design, and conveniently affords lighting in any area or place where illumination is needed, without requiring the installation and associated cost, of a light fixture. Such an assembly is easily installed through the use of an adhesive strip located on the rear side of the invention. The assembly is portable and is advantageously powered by batteries or standard AC current. The assembly can conveniently be placed almost anywhere in a home, business or other public facility. The assembly can be displayed in a decorative manner, and either be hung vertically or horizontally to display artwork or just to add more light to an area. The assembly is inexpensive and energy efficient.

BRIEF SUMMARY OF THE INVENTION

In view of the foregoing background, it is therefore an object of the present invention to provide an apparatus for a portable under-mount lighting assembly. These and other objects, features, and advantages of the invention are provided by a portable under-mount lighting assembly for illuminating a space-restricted region.

The assembly includes a base plate that has a centrally registered longitudinal axis and a pair of oppositely registered linear edges equidistantly spaced from the axis. Such linear edges effectively extend parallel to the axis and along an entire longitudinal length of the base plate. Each of the linear edges is conveniently provided with an L-shaped flange portion monolithically formed therewith and contiguously extending along an entire longitudinal length thereof. Such flange portions advantageously terminate at a predetermined distance above a top surface of the base plate and effectively define a gap therebetween respectively.

The assembly further includes a plurality of light fixtures adjustably positional along the base plate, and each of such light fixtures has an LED conveniently housed therein. A plurality of slots is conveniently formed within the base plate. Each of such slots has first, second, third and fourth segments aligned along independent and equidistantly offset quadrants such that each of the light fixtures is advantageously positional along first, second, third and fourth passageways respectively. Each of such first, second, third and fourth passageways are conveniently spaced approximately 90 degrees apart for advantageously allowing the user to effectively displace each of the light fixtures along mutually orthogonal directions. The base plate includes planar top and bottom surfaces effectively extending along the entire longitudinal length thereof such that the light fixtures can freely slide along the slots and advantageously remain coplanar during operating conditions.

The assembly further includes a mechanism for conveniently sliding the light fixtures within the slots such that each of the light fixtures is independently adaptable along a plurality of non-intersecting paths defined intermediately of the linear edges respectively. The light fixture sliding mechanism includes a plurality of annular anchor members directly coupled to respective top surfaces of the light fixtures. Each of such anchor members traverses upwardly and effectively penetrates through a corresponding one of the slots such that each anchor member has a bottom surface seated directly on the top surface of the base plate.

Each of the anchor members has a diameter greater than a width of the passageways such that an outer lip of each of the anchor members linearly slides along the bottom surface of the base plate. Each of the anchor members is preferably provided with a linear central bore effectively passing through an entire thickness thereof for allowing the user to conveniently change the LEDs housed within the light fixtures respectively while the light fixtures advantageously remain intact with the base plate.

The assembly further includes a mechanism for releasably and independently locking each of the light fixtures within corresponding ones of the slots such that each of the light fixtures is statically coupled to an alternate one of the slots during operating conditions. Such an independent locking mechanism includes at least two fingers directly coupled to a bottom surface of the base plate. Each of such fingers extends downwardly and terminates at a distance above a bottom surface of the light fixtures. Each of the fingers protrudes away from a center of corresponding ones of the light fixtures. A plurality of cover plates is provided with a respective groove formed therein. Each of such grooves has a top shoulder formed therewith such that the fingers adjustably sit below the shoulders and effectively prevent the cover plates from detaching away from the base plate.

The assembly further includes a mechanism for removably under-mounting the linear edges to a bottom surface of a support. The light fixtures are freely positional along the corresponding slots after the linear edges have been attached to the support. Such an under mounting mechanism preferably includes a pair of adhesive strips directly connected to the linear edges and effectively extending along the entire longitudinal lengths thereof respectively. The adhesive strips have a top surface directly affixed to the bottom surface of the support such that the base plate and the light fixtures are advantageously suspended above a ground surface. The under-mounting mechanism and the sliding mechanism are effectively spaced apart such that the user can simultaneously detach and slide selected ones of the light fixtures while remaining ones of the light fixtures advantageously maintain static spatial relationships with the base plate.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
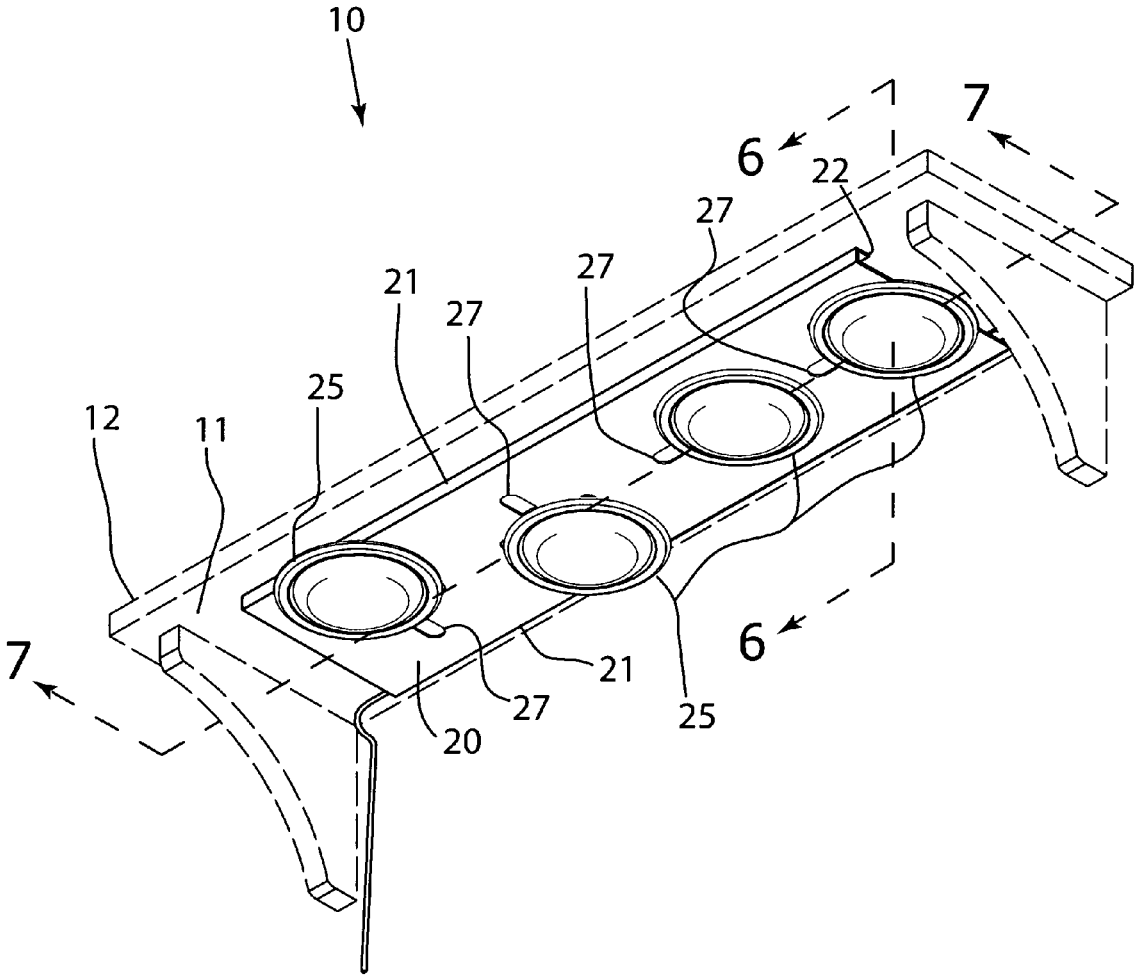
FIG. 1 is a perspective view showing a portable under-mount lighting assembly attached to a support, in accordance with the present invention.
Figure 2:
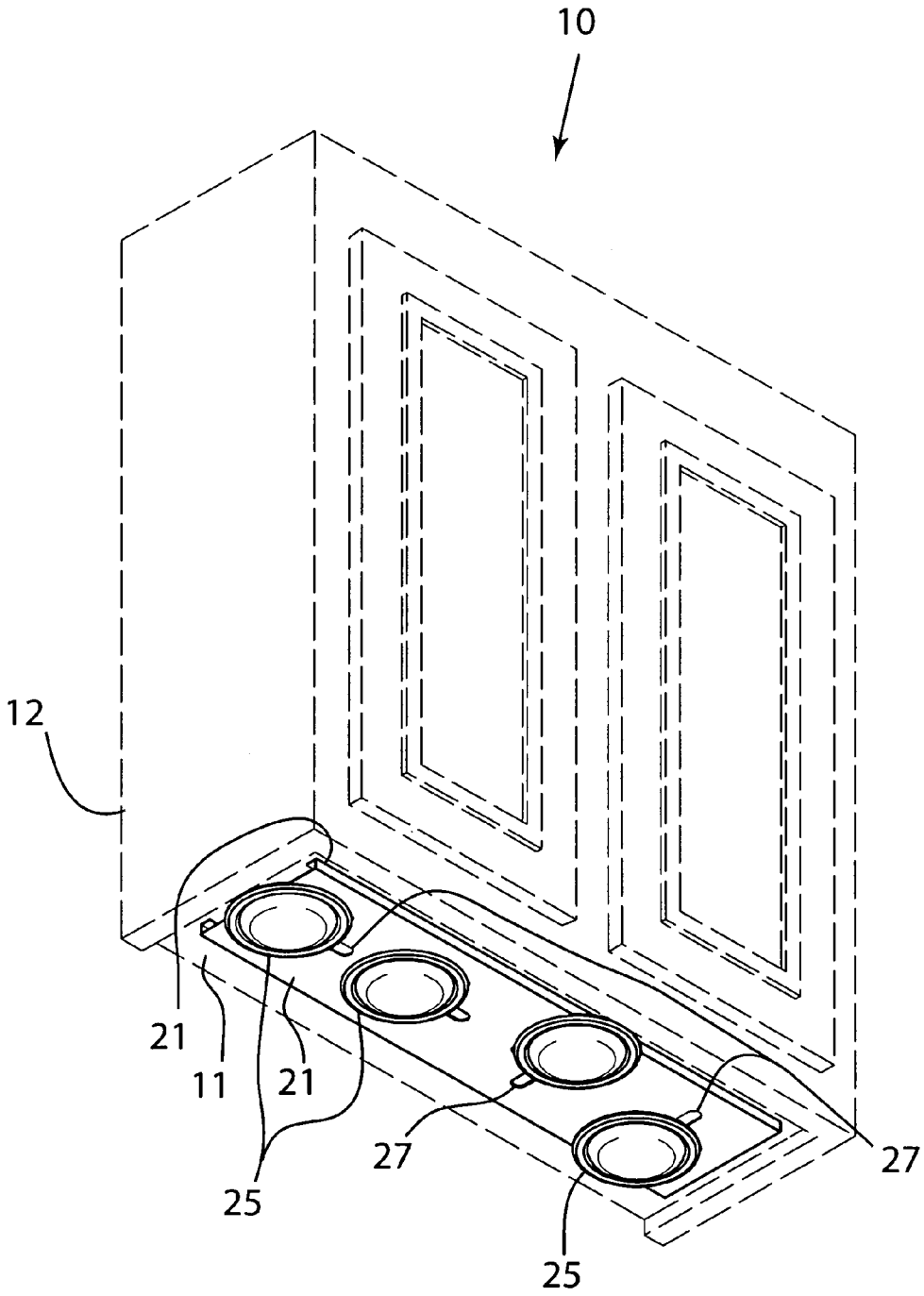
FIG. 2 is a perspective view of the assembly shown in FIG. 1 showing the assembly attached to an alternate support.
Figure 3:
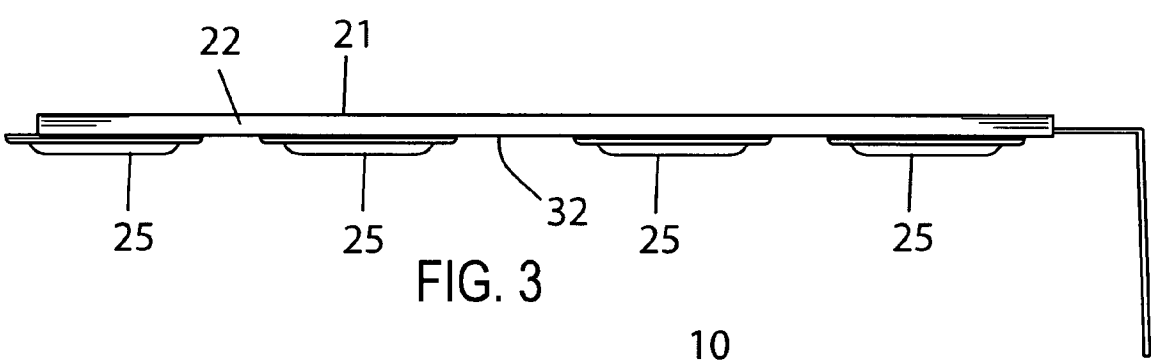
FIG. 3 is a side elevational view of the assembly shown in FIG. 1.
Figure 5:
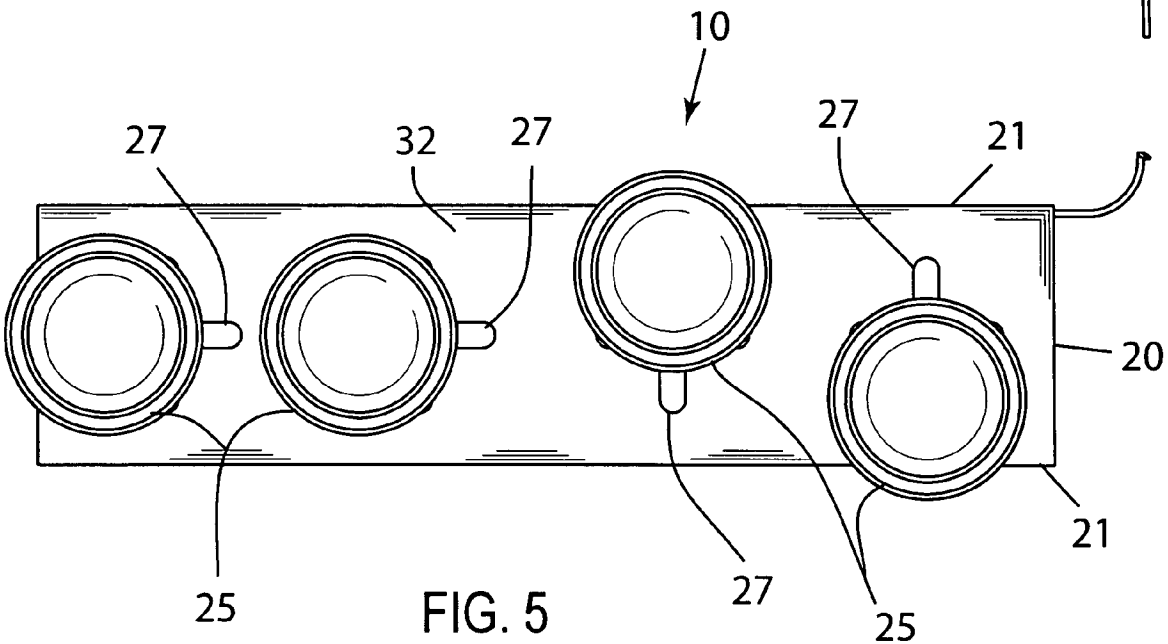
FIG. 5 is a top plan view of the assembly shown in FIG. 3.
Figure 4:
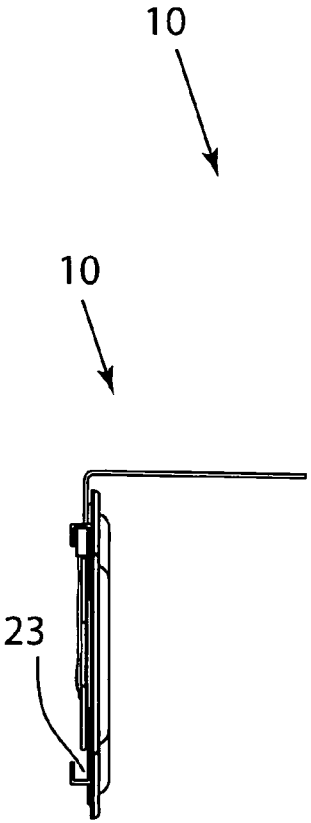
FIG. 4 is a side elevational view of the assembly shown in FIG. 3 viewed from an end of the assembly.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1-8 by the reference numeral 10 and is intended to provide a portable under-mount lighting assembly. It should be understood that the assembly 10 may be mounted on many different types of surfaces and should not be limited in use to mounting on only those surfaces described herein.

Referring initially to FIGS. 1, 2, 3, 4, 5, 6, 7 and 8, the assembly 10 includes a base plate 20 that has a centrally registered longitudinal axis and a pair of oppositely registered linear edges 21 equidistantly spaced from the axis. Such linear edges 21 extend parallel to the axis and along an entire longitudinal length of the base plate 20. Each of the linear edges 21 is provided with an L-shaped flange portion 22 monolithically formed therewith and contiguously extending along an entire longitudinal length thereof. Such flange portions 22 advantageously terminate at a predetermined distance above a top surface 23 of the base plate 20 and define a gap 24 therebetween respectively.

Again referring to FIGS. 1 through 8, the assembly 10 further includes a plurality of light fixtures 25 adjustably positional along the base plate 20, and each of such light fixtures 25 has an LED 26 housed therein. Of course, such light fixtures 25 can be produced in a variety of sizes, as is obvious to a person of ordinary skill in the art. A plurality of slots 27 is advantageously formed within the base plate 20. Each of such slots 27 has first 28A, second 28B, third 28C and fourth 28 D segments aligned along independent and equidistantly offset quadrants, which is essential such that each of the light fixtures 25 is advantageously positional along first 31A, second 31B, third 31C and fourth 31D passageways respectively.

Each of such first, second, third and fourth passageways 31A, 31B, 31C, 31D are spaced approximately 90 degrees apart, which is critical for advantageously allowing the user to displace each of the light fixtures 25 along mutually orthogonal directions. The base plate 20 includes planar top 23 and bottom 32 surfaces extending along the entire longitudinal length thereof, which is crucial such that the light fixtures 25 can freely slide along the slots 27 and advantageously remain coplanar during operating conditions.

Figure 6:
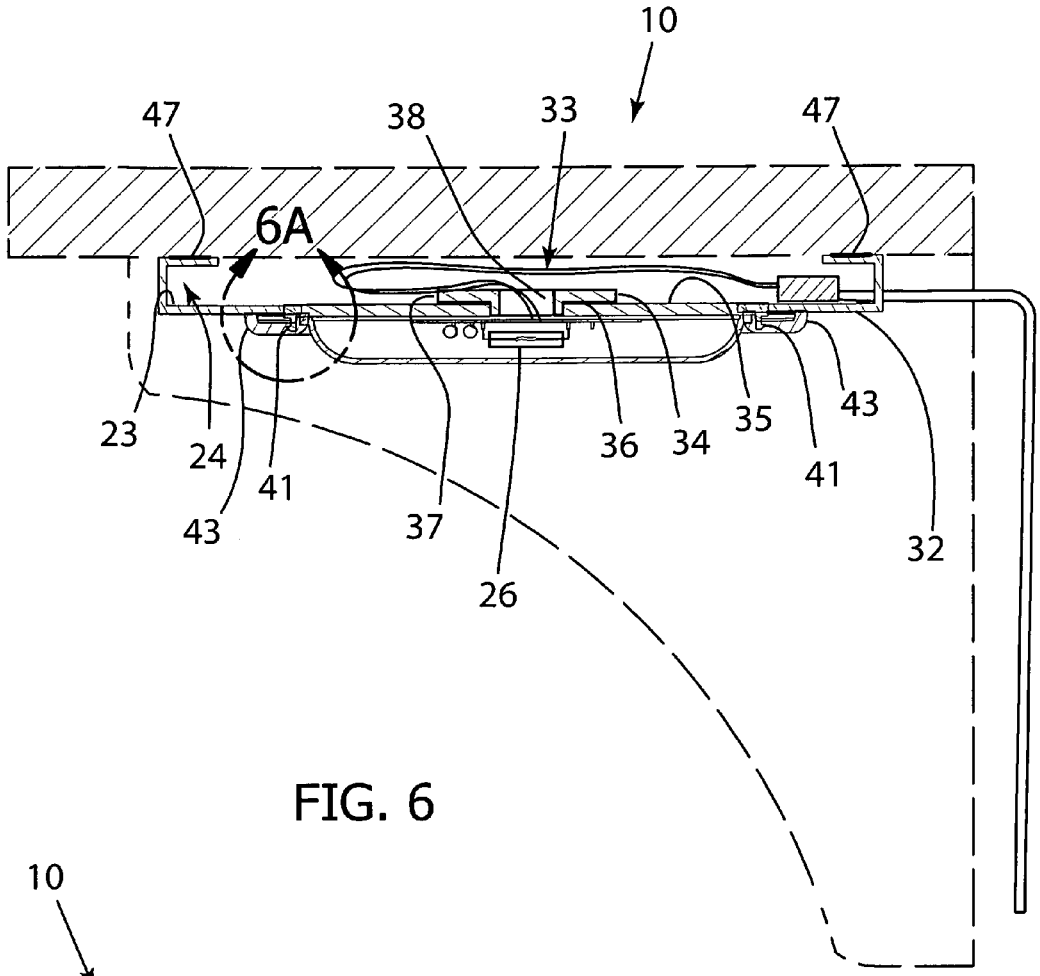
FIG. 6 is a cross sectional view of the assembly shown in FIG. 1, taken along line 6-6.
Figure 7:
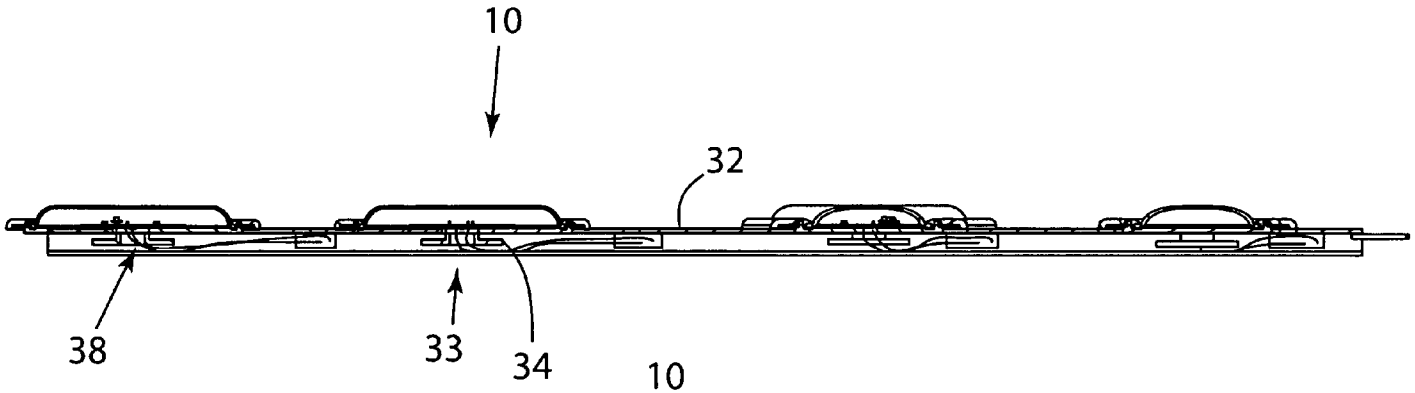
FIG. 7 is a cross sectional view of the assembly shown in FIG. 1, taken along line 7-7.
Figure 8:
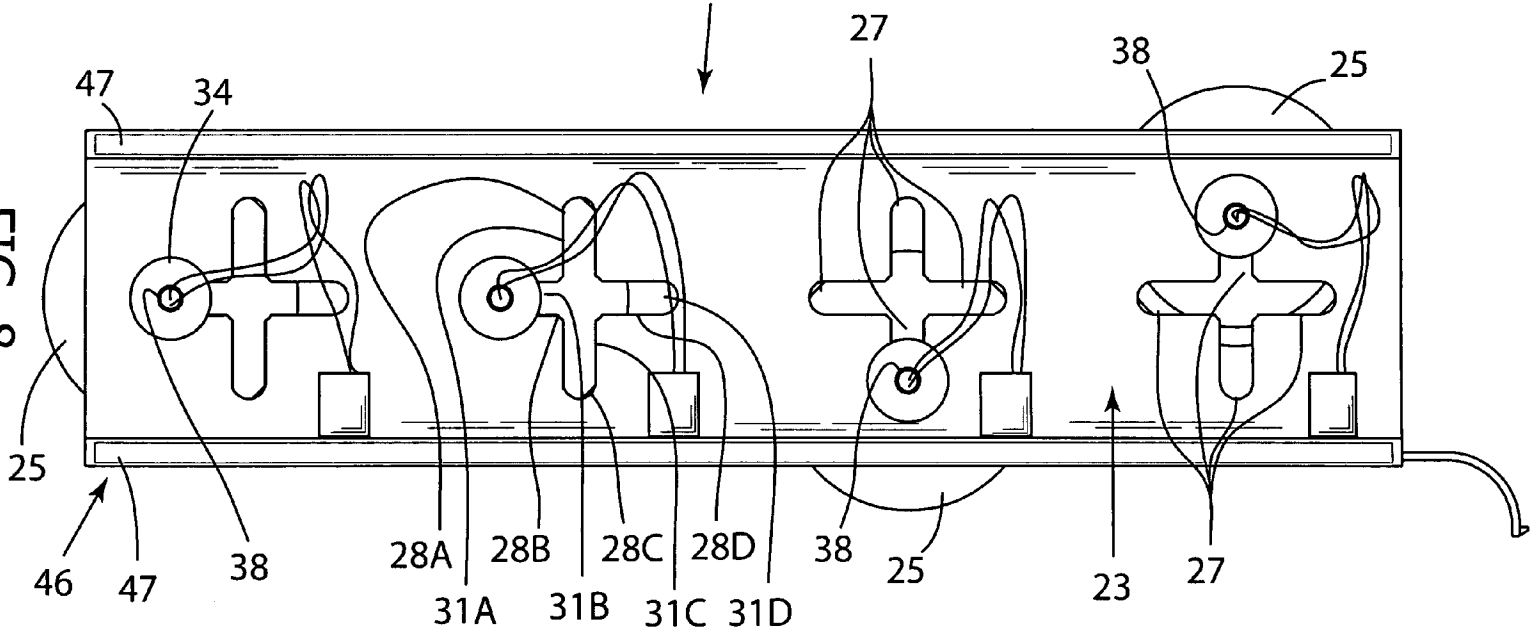
FIG. 8 is a bottom plan view of the assembly shown in FIG. 5.

Referring to FIGS. 6, 7 and 8, the assembly 10 further includes a mechanism 33 for sliding the light fixtures 25 within the slots 27, which is vital such that each of the light fixtures 25 is independently adaptable along a plurality of non-intersecting paths defined intermediately of the linear edges 21 respectively. The light fixture sliding mechanism 33 includes a plurality of annular anchor members 34 directly coupled to respective top surfaces 35 of the light fixtures 25, without the use of intervening elements. Each of such anchor members 34 traverses upwardly and penetrates through a corresponding one of the slots 27, which is important such that each anchor member 34 has a bottom surface 36 seated directly on the top surface 23 of the base plate 20, without the use of intervening elements. Such an abutting relationship allows the user to accurately align the anchor member 34 along the slotted flange portions 22 in the space-limited areas.

Again referring to FIGS. 6 and 7, each of the anchor members 34 has a diameter greater than a width of the passageways 31A, 31B, 31C, 31D, which is essential such that an outer lip 37 of each of the anchor members 34 linearly slides along the bottom surface of the base plate 20. Each of the anchor members 34 is preferably provided with a linear central bore 38 passing through an entire thickness thereof, which is critical for allowing the user to change the LEDs 26 housed within the light fixtures 25 respectively while the light fixtures 25 advantageously remain intact with the base plate 20.

Figure 6A:
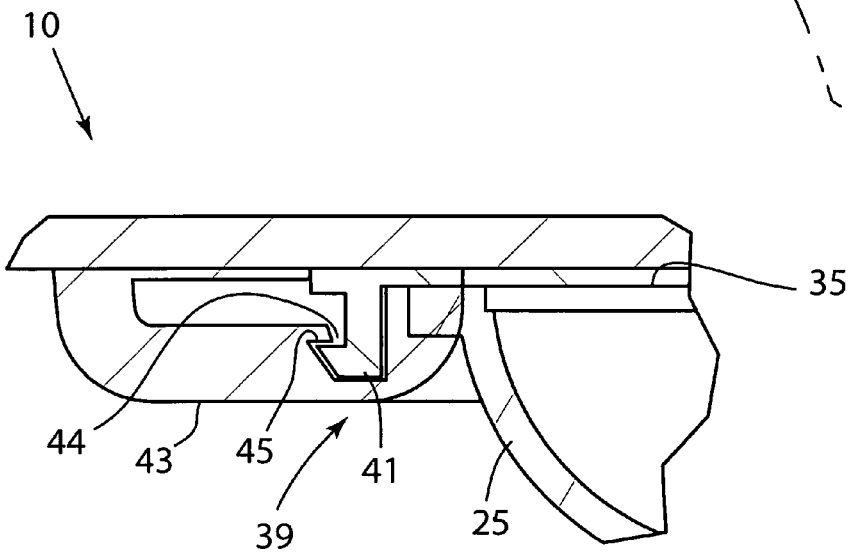
FIG. 6A is an expanded view of a portion of the assembly shown in FIG. 6.

Referring to FIG. 6A, the assembly 10 further includes a mechanism 39 for releasably and independently locking each of the light fixtures 25 within corresponding ones of the slots 27, which is crucial such that each of the light fixtures 25 is statically coupled to an alternate one of the slots 27 during operating conditions. Such an independent locking mechanism 39 includes at least two fingers 41 directly coupled to a bottom surface of the base plate 20, without the use of intervening elements. Each of such fingers 41 extends downwardly and terminates at a distance above a bottom surface of the light fixtures 25, and protrudes away from a center of corresponding ones of the light fixtures 25.

A plurality of cover plates 43 is provided with a respective groove 44 formed therein. Each of such grooves 44 has a top shoulder 45 formed therewith, which is vital such that the fingers 41 adjustably sit below the shoulders 45 and advantageously prevent the cover plates 43 from prematurely detaching away from the base plate 20. Of course, such grooves 44 can be formed in a variety of sizes, as is obvious to a person of ordinary skill in the art.

Referring to FIGS. 6 and 8, the assembly 10 further includes a mechanism 46 for removably under-mounting the linear edges 21 to a bottom surface 11 of a support 12. The light fixtures 25 are freely positional along the corresponding slots 27 after the linear edges 21 have been attached to the support 12. Such an under mounting mechanism 46 preferably includes a pair of adhesive strips 47 directly connected to the linear edges 21, without the use of intervening elements, and extending along the entire longitudinal lengths thereof respectively. Of course, such adhesive strips 47 can be formed from a variety of suitable adhesives, as is obvious to a person of ordinary skill in the art. The adhesive strips 47 have a top surface directly affixed to the bottom surface 11 of the support 12, without the use of intervening elements, which is important such that the base plate 20 and the light fixtures 25 are advantageously suspended above a ground surface.

The under-mounting mechanism 46 and the sliding mechanism 33 are spaced apart, which is essential such that the user can simultaneously detach and slide selected ones of the light fixtures 25 while remaining ones of the light fixtures 25 advantageously maintain static spatial relationships with the base plate 20. The ability to simultaneously detach and slide selected ones of the light fixtures 25 while remaining ones of the light fixtures 25 advantageously maintain static spatial relationships with the base plate 20, provides an unexpected benefit toggling the light fixtures 25 along the base plate 20 without having to detach the base plate 20 from the support, thereby overcoming prior art shortcomings.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A portable lighting assembly for illuminating a space-restricted region, said portable lighting assembly comprising:

a base plate having a centrally registered longitudinal axis and a pair of oppositely registered linear edges equidistantly spaced from the axis, said linear edges extending parallel to the axis and further extending along an entire longitudinal length of said base plate, each of said linear edges being provided with an L-shaped flange portion monolithically formed therewith and contiguously extending along an entire longitudinal length thereof, said flange portions terminating at a predetermined distance above a top surface of said base plate and defining a gap therebetween respectively;

a plurality of light fixtures adjustably positional along said base plate, each of said light fixtures having a light-emitting diode housed therein;

a plurality of slots formed within said base plate, each of said slots having first, second, third and fourth segments aligned along independent and equidistantly offset quadrants such that each of said light fixtures is positional along first, second, third and fourth passageways respectively;

means for sliding said light fixtures within said slots such that each of said light fixtures is independently adaptable along a plurality of non-intersecting paths defined intermediately of said linear edges respectively;

means for releasably and independently locking each of said light fixtures within corresponding ones of said slots such that each said light fixture is statically coupled to an alternate one of said slots during operating conditions; and means for removably under mounting said linear edges to a bottom surface of a support, wherein said light fixtures are freely positional along said corresponding slots after said linear edges have been attached to the support.

2. The portable lighting assembly of claim 1, wherein each of said first, second, third and fourth passageways are spaced approximately 90 degrees apart for allowing the user to displace each of said light fixtures along mutually orthogonal directions.

3. The portable lighting assembly of claim 1, wherein said light fixture sliding means comprises:

a plurality of annular anchor members directly coupled to respective top surfaces of said light fixtures, each anchor member traversing upwardly and penetrating through a corresponding one of said slots wherein each said anchor member has a bottom surface seated directly on said top surface of said base plate, wherein each of said anchor members has a diameter greater than a width of said passageways such that an outer lip of each of said anchor members linearly slides along said bottom surface of said base plate.

4. The portable lighting assembly of claim 3, wherein each of said anchor members is provided with a linear central bore passing through an entire thickness thereof for allowing the user to change said light-emitting diodes housed within said light fixtures respectively while said light fixtures remain intact with said base plate.

5. The portable lighting assembly of claim 1, wherein said independent locking means comprises:

at least two fingers directly coupled to a bottom surface of said base plate, each of said fingers extending downwardly and terminating at a distance above a bottom surface of said light fixtures, each of said fingers protruding away from a center of corresponding ones of said light fixtures; and a plurality of cover plates provided with a respective groove formed therein, each of said grooves having a top shoulder formed therewith such that said fingers adjustably sit below said shoulders and prevent said cover plates from detaching away from said base plate.

6. The portable lighting assembly of claim 1, wherein said under mounting means comprises:

a pair of adhesive strips directly connected to said linear edges and extending along the entire longitudinal lengths thereof respectively, said adhesive strips having a top surface directly affixed to the bottom surface of the support such that said base plate and said light fixtures are suspended above a ground surface.

7. A portable lighting assembly for illuminating a space-restricted region, said portable lighting assembly comprising:

a base plate having a centrally registered longitudinal axis and a pair of oppositely registered linear edges equidistantly spaced from the axis, said linear edges extending parallel to the axis and further extending along an entire longitudinal length of said base plate, each of said linear edges being provided with an L-shaped flange portion monolithically formed therewith and contiguously extending along an entire longitudinal length thereof, said flange portions terminating at a predetermined distance above a top surface of said base plate and defining a gap therebetween respectively;

a plurality of light fixtures adjustably positional along said base plate, each of said light fixtures having a light-emitting diode housed therein;

a plurality of slots formed within said base plate, each of said slots having first, second, third and fourth segments aligned along independent and equidistantly offset quadrants such that each of said light fixtures is positional along first, second, third and fourth passageways respectively, wherein said base plate has planar top and bottom surfaces extending along the entire longitudinal length thereof such that said light fixtures can freely slide along said slots and remain coplanar during operating conditions;

means for sliding said light fixtures within said slots such that each of said light fixtures is independently adaptable along a plurality of non-intersecting paths defined intermediately of said linear edges respectively;

means for releasably and independently locking each of said light fixtures within corresponding ones of said slots such that each said light fixture is statically coupled to an alternate one of said slots during operating conditions; and means for removably under mounting said linear edges to a bottom surface of a support, wherein said light fixtures are freely positional along said corresponding slots after said linear edges have been attached to the support.

8. The portable lighting assembly of claim 7, wherein each of said first, second, third and fourth passageways are spaced approximately 90 degrees apart for allowing the user to displace each of said light fixtures along mutually orthogonal directions.

9. The portable lighting assembly of claim 7, wherein said light fixture sliding means comprises:

a plurality of annular anchor members directly coupled to respective top surfaces of said light fixtures, each anchor member traversing upwardly and penetrating through a corresponding one of said slots wherein each said anchor member has a bottom surface seated directly on said top surface of said base plate, wherein each of said anchor members has a diameter greater than a width of said passageways such that an outer lip of each of said anchor members linearly slides along said bottom surface of said base plate.

10. The portable lighting assembly of claim 9, wherein each of said anchor members is provided with a linear central bore passing through an entire thickness thereof for allowing the user to change said light-emitting diodes housed within said light fixtures respectively while said light fixtures remain intact with said base plate.

11. The portable lighting assembly of claim 7, wherein said independent locking means comprises:

at least two fingers directly coupled to a bottom surface of said base plate, each of said fingers extending downwardly and terminating at a distance above a bottom surface of said light fixtures, each of said fingers protruding away from a center of corresponding ones of said light fixtures; and a plurality of cover plates provided with a respective groove formed therein, each of said grooves having a top shoulder formed therewith such that said fingers adjustably sit below said shoulders and prevent said cover plates from detaching away from said base plate.

12. The portable lighting assembly of claim 7, wherein said under mounting means comprises:

a pair of adhesive strips directly connected to said linear edges and extending along the entire longitudinal lengths thereof respectively, said adhesive strips having a top surface directly affixed to the bottom surface of the support such that said base plate and said light fixtures are suspended above a ground surface.

13. A portable lighting assembly for illuminating a space-restricted region, said portable lighting assembly comprising:

a base plate having a centrally registered longitudinal axis and a pair of oppositely registered linear edges equidistantly spaced from the axis, said linear edges extending parallel to the axis and further extending along an entire longitudinal length of said base plate, each of said linear edges being provided with an L-shaped flange portion monolithically formed therewith and contiguously extending along an entire longitudinal length thereof, said flange portions terminating at a predetermined distance above a top surface of said base plate and defining a gap therebetween respectively;

a plurality of light fixtures adjustably positional along said base plate, each of said light fixtures having alight-emitting diode housed therein;

a plurality of slots formed within said base plate, each of said slots having first, second, third and fourth segments aligned along independent and equidistantly offset quadrants such that each of said light fixtures is positional along first, second, third and fourth passageways respectively, wherein said base plate has planar top and bottom surfaces extending along the entire longitudinal length thereof such that said light fixtures can freely slide along said slots and remain coplanar during operating conditions;

means for sliding said light fixtures within said slots such that each of said light fixtures is independently adaptable along a plurality of non-intersecting paths defined intermediately of said linear edges respectively;

means for releasably and independently locking each of said light fixtures within corresponding ones of said slots such that each said light fixture is statically coupled to an alternate one of said slots during operating conditions; and means for removably under mounting said linear edges to a bottom surface of a support, wherein said light fixtures are freely positional along said corresponding slots after said linear edges have been attached to the support, wherein said under mounting means and said sliding means are spaced apart such that the user can simultaneously detach and slide selected ones of said light fixtures while remaining ones of said light fixtures maintain static spatial relationships with said base plate.

14. The portable lighting assembly of claim 13, wherein each of said first, second, third and fourth passageways are spaced approximately 90 degrees apart for allowing the user to displace each of said light fixtures along mutually orthogonal directions.

15. The portable lighting assembly of claim 13, wherein said light fixture sliding means comprises:

a plurality of annular anchor members directly coupled to respective top surfaces of said light fixtures, each anchor member traversing upwardly and penetrating through a corresponding one of said slots wherein each said anchor member has a bottom surface seated directly on said top surface of said base plate, wherein each of said anchor members has a diameter greater than a width of said passageways such that an outer lip of each of said anchor members linearly slides along said bottom surface of said base plate.

16. The portable lighting assembly of claim 15, wherein each of said anchor members is provided with a linear central bore passing through an entire thickness thereof for allowing the user to change said light-emitting diodes housed within said light fixtures respectively while said light fixtures remain intact with said base plate.

17. The portable lighting assembly of claim 13, wherein said independent locking means comprises:

at least two fingers directly coupled to a bottom surface of said base plate, each of said fingers extending downwardly and terminating at a distance above a bottom surface of said light fixtures, each of said fingers protruding away from a center of corresponding ones of said light fixtures; and a plurality of cover plates provided with a respective groove formed therein, each of said grooves having a top shoulder formed therewith such that said fingers adjustably sit below said shoulders and prevent said cover plates from detaching away from said base plate.

18. The portable lighting assembly of claim 13, wherein said under mounting means comprises:

a pair of adhesive strips directly connected to said linear edges and extending along the entire longitudinal lengths thereof respectively, said adhesive strips having a top surface directly affixed to the bottom surface of the support such that said base plate and said light fixtures are suspended above a ground surface.

* * * * *